United States Patent [19]

Behrens

[11] Patent Number: 4,589,151

[45] Date of Patent: May 20, 1986

[54] SLATTED BED SYSTEM

[76] Inventor: Robert S. Behrens, 1855 Elmira Ct., St. Louis, Mo. 63141

[21] Appl. No.: 512,090

[22] Filed: Jul. 8, 1983

[51] Int. Cl.[4] ..... A61G 7/06; A47C 23/06

[52] U.S. Cl. ..... 5/66; 5/68; 5/69; 5/237

[58] Field of Search ..... 5/66–69, 5/236 R, 236 B, 237, 238, 465, 508, 481

[56] References Cited

U.S. PATENT DOCUMENTS

| | | | |
|---|---|---|---|
| 202,936 | 4/1878 | Doll et al. | 5/66 |
| 594,846 | 12/1897 | Bennett | 5/66 |
| 2,835,906 | 5/1958 | Robbins | 5/465 |
| 3,058,126 | 10/1962 | Fleming et al. | 5/465 |
| 3,127,619 | 4/1964 | Bronstien | 5/68 |
| 3,813,713 | 6/1974 | Kipfer | 5/238 |
| 3,916,461 | 11/1975 | Kerstholt | 5/66 |
| 3,921,230 | 11/1975 | Hanning et al. | 5/66 |
| 4,277,858 | 7/1981 | Bohme | 5/66 |
| 4,381,571 | 5/1983 | Elliott | 5/66 |
| 4,397,053 | 8/1983 | Fanti | 5/481 |

FOREIGN PATENT DOCUMENTS

| | | | |
|---|---|---|---|
| 2031471 | 1/1972 | Fed. Rep. of Germany | 5/67 |
| 380 | of 1866 | United Kingdom | 5/238 |
| 121362 | 12/1918 | United Kingdom | 5/237 |

*Primary Examiner*—Thomas J. Holko
*Assistant Examiner*—Michael F. Trettel
*Attorney, Agent, or Firm*—L. Lawton Rogers, III

[57] ABSTRACT

A slatted bed system comprising an articulating frame, a power unit, concave slats, a sculptured mattress and free standing support means. The articulating frame is in four sections to facilitate the independent raising of the head end and the portion under an individual's knee by two independently operable linear actuators. The slats are filament wound fiberglass epoxy of a downwardly concave shape and are sized in thickness and width to provide a predetermined spring rate. The number of slats, slat spacing and spring rate of each slat may be tailored for the body weight distribution of the individual for whom the bed is designed, as may the cross-sectional dimensions of the slats. The mattress is molded from high resiliency foam and is sculptured at the frame pivot points. While the mattress spans the slats, the feel, comfort and body support are provided by the slat system. A wooden enclosure provides a finished look and optional additional support for the central power unit, or two independent power units if incorporated, e.g., in a king size bed.

8 Claims, 7 Drawing Figures

SLATTED BED SYSTEM

BACKGROUND OF THE INVENTION

The present invention relates to a slatted bed system and more particularly to a selectively articulated slatted bed system individually tailored or customized for the body weight distribution of an individual.

Articulating beds are well known and are widely used in hospitals and as loungers. Examples of such systems include the Mann U.S. Pat. No. 3,216,026 dated Nov. 9, 1965; the Holm U.S. Pat. No. 3,278,952 dated Oct. 18, 1966; the Swatt U.S. Pat. No. 3,644,946 dated Feb. 29, 1972; the Ferro U.S. Pat. No. 4,095,296 dated June 20, 1978; and the Zur U.S. Pat. No. 4,258,445 dated Mar. 31, 1981. The known prior art systems such as represented by the aforementioned patents generally contain two or more power actuators for the articulation of three or more sections of the bed. In such systems, the power unit is generally complex, and the comfort for the patient is the function of the quality of the mattress placed thereon. Such beds may be customized to a particular individual only by the exchange of one mattress for another, and mattresses generally do not vary over the length thereof as does the body weight distribution of individuals.

Slatted bed systems are also known and are shown, for example, in the Degen U.S. Pat. No. 3,067,438 dated Dec. 11, 1962 and the Sproll U.S. Pat. No. 3,553,745 dated Jan. 12, 1971. Such known slatted bed systems are generally planer with the exception of an articulating head portion. The position of the slats is not generally adjustable and comfort variations may be made only by adjusting the position of supports underlying the downwardly concave slats to limit the flexing thereof. In this way, the "hardness" of the bed system may be adjusted, but no adjustment can be made for variations in body weight distribution.

It is also known to sculpture the underside of a mattress support along the hinge lines of an articulating bed to facilitate the bending of the mattress, the comfort for the individual residing in the selected articulation of the frame and mattress support system as a single unit and the quality of the mattress. Such sculptured mattress supports are shown, for example, in the Propst U.S. Pat. No. 3,780,387 dated Dec. 25, 1973.

It is accordingly an object of the present invention to provide a bed system which obviates many of the deficiencies of the known prior art bed systems and to provide a bed system which may be easily tailored to the body weight distribution of a particular individual.

It is another object of the present invention to provide a slatted bed system which is simple in construction and contained in an enclosure to provide a finished appearance.

It is a further object of the present invention to provide a novel slatted bed system in which the mattress may be sculptured to facilitate conformity to the bed system when articulated.

It is still another object of the present invention to provide a novel slatted bed system in which all of the force generated in the articulation of the bed system is reacted in a compact central power unit.

It is yet another object of the present invention to provide a novel slatted bed system in which the number spacing and spring rate of the slats may be selectively varied to modify the support characteristics of the bed system.

These and other objects and advantages will be readily apparent to one skilled in the art to which the invention pertains from a reading of the claims and the following detailed description of a preferred embodiment in conjunction with the appended drawings.

THE DRAWINGS

THE DETAILED DESCRIPTION

Figure 1:
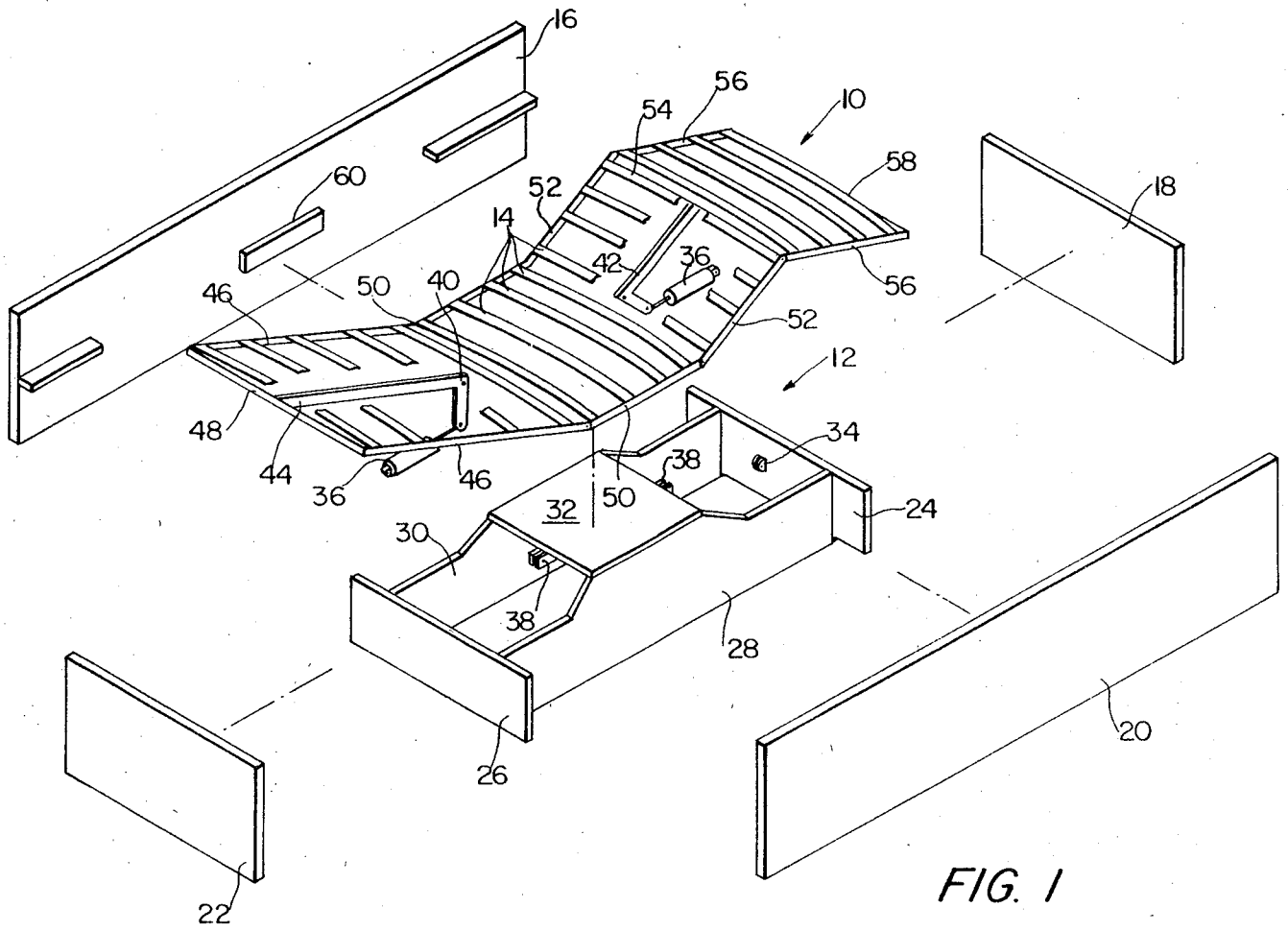
FIG. 1 is an exploded pictorial view of one embodiment of the slatted bed system of the present invention.

With reference to the preferred embodiment of the slatted bed system of the present invention illustrated in FIG. 1, the system includes an articulating frame 10, a power unit 12, a plurality of slats 14, a supporting enclosure 16, 18, 20, 22 and a mattress (not shown).

With continued reference to FIG. 1, the power unit may be free standing and comprises a pair of end supports 24 and 26, a pair of side supports 28 and 30 and a horizontal support 32, all rigidly connected in a suitable conventional manner to provide a stable and rigid support. An attachment 34 is provided on the inside of the end supports 24 and 26 for attachment to the linear actuators 36. A horizontal support 32 is also used to provide a support 38 for the interconnection 40 of the L-shaped cranks 42, 44 of the articulating frame 10.

Control of the linear actuators 36 may be any conventional control system having remote switches conveniently located within the reach of the individual using the slatted bed system. The linear actuators 36 may be of any suitable conventional type such as a hydraulic actuator or electrical motor. The power unit is thus central and compact, and all of the forces generated in the articulation of the bed system are reacted therein.

With continued reference to FIG. 1, the articulating frame 10 comprises (a) a movable head portion having a generally C-shape with a pair of side members 46 and a head end member 48; (b) a fixed seat portion comprising side members 50; (c) a C-shaped thigh portion comprising side members 52 and cross member 54; and (d) a C-shaped foot portion comprising side members 56 and foot end member 58.

Figure 3:
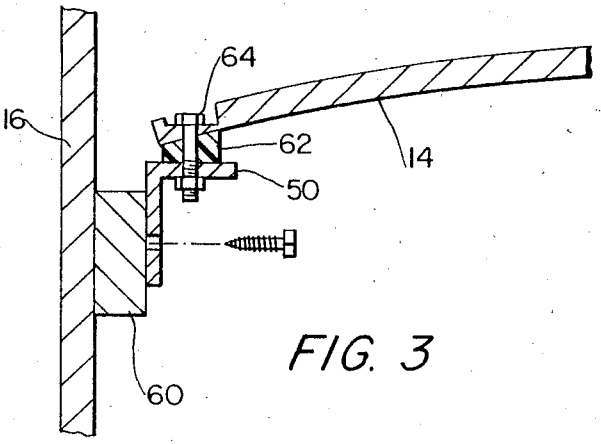
FIG. 3 is an elevation in cross-section taken through one of the slats showing the mounting thereof to the frame and the mounting of the frame to the support system.
Figure 2:
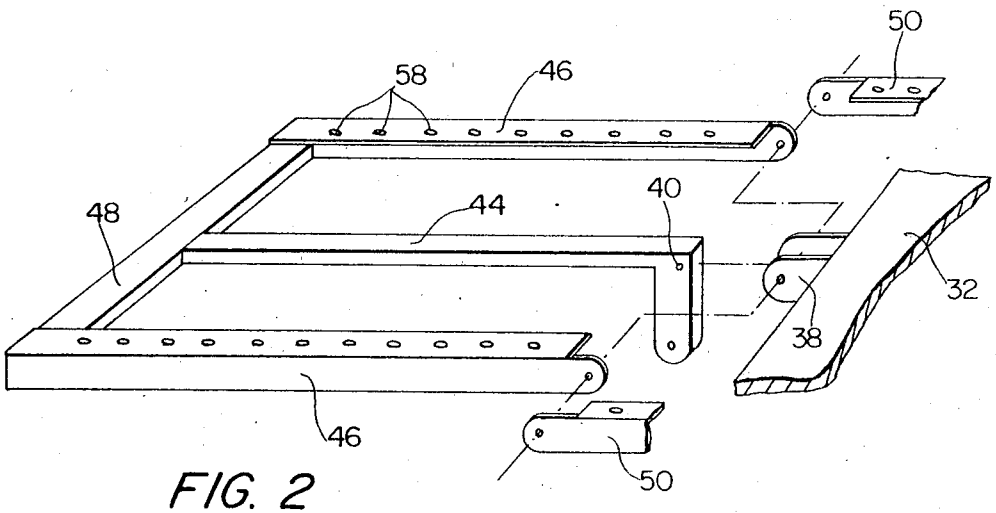
FIG. 2 is a pictorial view of the head portion of the frame showing the attachment thereof to the power unit.

As shown in more detail in FIGS. 2 and 3, the members of the various portions of the articulating frame may be angle iron in construction and are desirably provided with a plurality of apertures 58 along the upper surfaces thereof for the selective attachment of the slats 14.

As shown in FIG. 2, the interconnection 40 of the longer and shorter portions of the crank 44 are secured to the supports 38 on the power unit 12 of FIG. 1 by any suitable conventional means such as a threaded fastener (not shown). Similarly, the side members of the articulating frame may be connected by any suitable conventional means such as threaded fasteners.

As shown in FIG. 3, the side members 50 of the stationary seat portion of the frame may be connected to a reinforcing member 60 of one of the side walls 16 of the enclosure, or alternatively to the power unit. The individual slats 14 may be connected to the side member 50 by means of a resilient support 62 by any suitable conventional means such as a threaded fastener 64.

The slats may be filament wound fiberglass epoxy of a downwardly concave shape as shown generally in FIG. 3. The slats 14 may be sized in thickness and/or in width to provide different spring rates, with thickness being more effective in influencing stiffness. The number of slats and the spacing between the slats may be selectively varied to provide the most comfortable and healthy support for the body weight distribution of the particular individual for whom the slatted bed system is designed. In this regard, spine curvature in both supine and side positions may be considered.

By way of example, a typical slat may comprise 29 plies of #7781 style fiberglass cloth in a polyester resin to provide a thickness of 2.75 inches, a width of 5.0 inches and a camber of 0.875 inches over a 36 inch length. Typically, slat spacing will be 4.0 to 6.0 inches.

By the direction of one end of the linear actuators 36 to the supports 34 of the power unit at the other end of the linear actuator 36 through the shorter arm of the crank 42 to the support 38 of the power unit, all actuator loads are carried and reacted within the power unit as earlier explained. The length of the arm of the crank 42 should be compatible with the type of actuators used.

Figure 4:
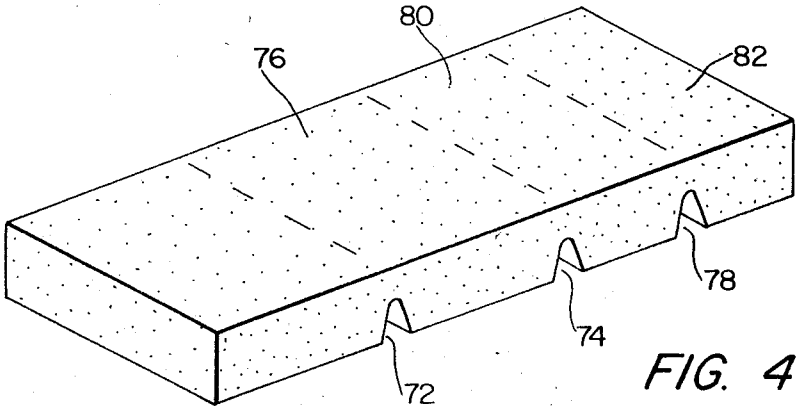
FIG. 4 is a pictorial view of a sculptured mattress according to the present invention.

With reference to FIG. 4, the mattress may be made of any suitable conventional type such as a slab of high resiliency molded foam. The primary purpose of the mattress is to span the slats with the feel, comfort, and body support being provided by the slat system rather than the mattress. The conformity of the mattress to the articulating frame as it articulates is enhanced by sculpturing of the mattress, i.e., the provision of suitable grooves at the points overlying the points of articulation of the frame 10. Because the severity of buckling increases with thickness, the thickness of the mattress is desirably less than about four inches; and preferably about two inches.

Figure 5:
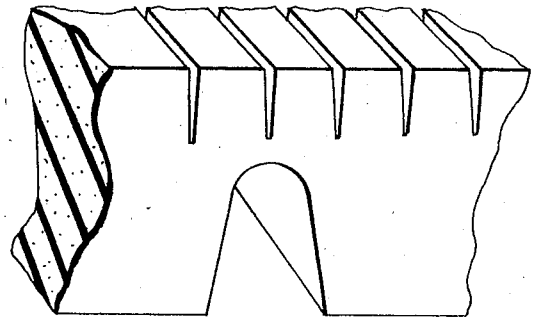
FIG. 5 is a pictorial view in partial section of the mattress of FIG. 4.

The width of the grooves 72 and 74 may be slight inasmuch as the mattress is not intended to be lowered beneath the plane of the portions 76 overlying the fixed seat portion of the frame. However, the width of the groove 78 must be sufficient to permit the bending together of the portion 80 overlying the thigh section of the articulating frame and the section 82 overlying the foot portion of the articulating frame as shown in FIG. 5.

The pillows may be molded if desired in a foam stiff enough to span the slats without interfering with the independent operation thereof.

ADVANTAGES AND SCOPE OF INVENTION

The advantages of the slatted bed system of the present invention will be readily apparent to those skilled in the art. By the use of slats of different spring rates, and by selectively adjusting the number and spacing between the slats, and/or the cross-sectional dimensions of the slats, the body weight distribution of a particular individual may be accommodated.

The use of two linear actuators requires a minimum of mechanical linkages to achieve the desired degree of articulation with a minimum of control circuitry.

The power unit may be free standing and provides the necessary structural support and is self contained in that all actuator loads are carried and reacted therein. The enclosure for the power unit provides a finished look to the system.

Figure 6:
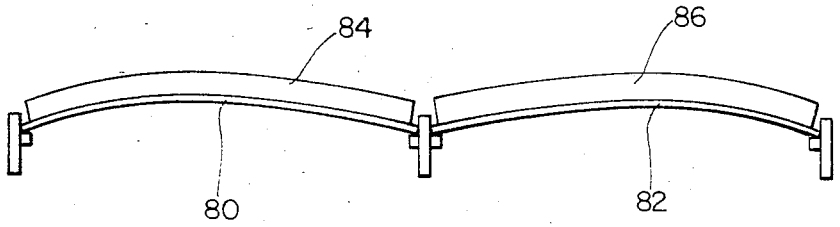
FIG. 6 is a schematic cross-sectional representation of a two independent slot system.

The system as described above may be made to accommodate beds of various sizes. For example, and as illustrated in FIG. 6, two independent systems of slats 80, 82 may be used for a king size bed with two mattresses 84, 86; all within a common frame.

Figure 7:
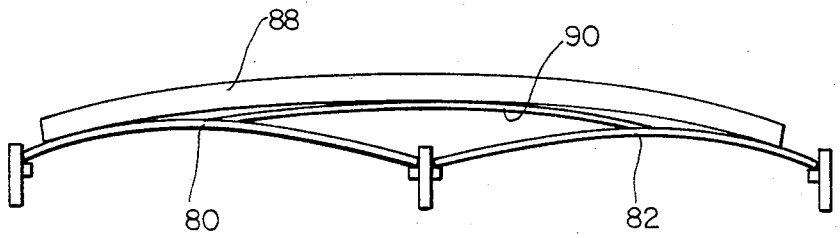
FIG. 7 is a schematic cross-sectional representation of a three slat system for a relatively large non-articulating bed.

Alternatively as shown in FIG. 7 for a non-articulating king size bed may utilize a two slat system 80, 82 with a single large mattress 88. To prevent a "dead" zone in the center, a third set of slats 90 may be used.

These and many other advantages will be apparent from the claims and it is to be understood that the foregoing is a description of a preferred embodiment, that many modifications will occur to those skilled in the art, and that the invention is limited to the language of the following claims when accorded a full range of equivalents.

What is claimed is:

1. A slatted bed system comprising:

(a) support means;

(b) an articulating frame carried by said support means, said frame having a head movable portion, a fixed portion, a thigh movable portion and a foot portion, said fixed portion including a pair of side members supported by said support means, said head portion including two side members and a head end member rigidly secured thereto at one end, each of said side members being pivotably secured at the other end thereof to the adjacent end of one of the side members of said fixed portion, said thigh portion including two side members and a cross member rigidly secured thereto adjacent the end thereof nearest to said foot portion, said side members being secured at the other end thereof to the adjacent ends of the side members of said fixed portion, said foot portion including two side members and a foot end member rigidly secured thereto at one end, each of said side members being pivotably secured at the other end thereof to the end of one of the side members of said knee portion;

(c) a first L-shaped crank having the longest portion thereof approximately the length of the side members of said head portion, the longest portion thereof being rigidly secured at the free end thereof to said head member intermediate the ends thereof, and the junction of the longer portion and the shorter portion being pivotably secured to said support means with the free end thereof extending downwardly;

(d) a first linear actuator carried at one end by said support means adjacent said head member and pivotably connected at the other end to the free end of the shorter portion of said first L-shaped crank whereby the contracting of said first linear actuator effects a raising of said head member and whereby the extending of said first linear actuator effects a lowering of said head member;

(e) a second L-shaped crank having the longest portion thereof approximating the length of the side member of said knee portion, the longest portion thereof being rigidly secured at the free end thereof to said cross member intermediate the ends thereof, and the juncture of the longer portion and the shorter portion being pivotably secured to said support means with the free end thereof extending downwardly;

(f) a second linear actuator carried at one end by said support means adjacent said foot member and pivotably connected at the other end to the free end of the shortest portion of said second L-shaped crank whereby the contracting of said second linear actuator effects a raising of the junction of said thigh portion and said foot portion and whereby the extending of said second linear actuator effects a lowering of the junction of said thigh portion and said foot portion;

(g) a plurality of resilient supports;

(h) a plurality of transverse slats carried at opposite ends by the side members of said head, fixed, thigh and foot portions, each of said slats being concave downwardly and selectively positionable along the length of the bed parallel to said foot, cross and head members;

(i) means for removably securing the ends of said slats to one of said side members through one of said resilient supports; and (j) a mattress conforming in dimension to said articulating frame and adapted to overlie said slats, said mattress having a transverse groove on the underside thereof overlying each of the junctions of said head portion with said fixed position and said thigh portion with said fixed portion, said grooves extending upwardly over one-half the thickness of the mattress to thereby permit the bending of the mattress as said head portion and or said thigh portion is raised, said mattress having a transverse groove on the underside thereof overlying the junction of said thigh and foot portions, said groove extending upwardly over one-half the thickness of the mattress and having sufficient width to permit bending of the mattress as the junction of said thigh and foot portions is raised.

2. A slatted bed system comprising:

(a) support means;

(b) an articulating frame carried by said support means, said frame having a head movable portion, a fixed portion, a thigh movable portion and a foot portion, said fixed portion including a pair of side members supported by said support means, said head portion including two side members and a head end member rigidly secured thereto at one end, each of said side members being pivotably secured at the other end thereof to the adjacent end of one of the side members of said fixed portion, said thigh portion including two side members and a cross member rigidly secured thereto adjacent the end thereof nearest to said foot portion, said side members being secured at the other end thereof to the adjacent ends of the side members of said fixed portion, said foot portion including two side members and a foot end member rigidly secured thereto at one end, each of said side members being pivotably secured at the other end thereof to the end of one of the side members of said knee portion;

(c) a first L-shaped crank having the longest portion thereof approximately the length of the side members of said head portion, the longest portion thereof being rigidly secured at the free end thereof to said head member intermediate the ends thereof, and the junction of the longer portion and the shorter portion being pivotably secured to said support means with the free end thereof extending downwardly;

(d) a first linear actuator carried at one end by said support means adjacent said head member and pivotably connected at the other end to the free end of the shorter portion of said first L-shaped crank whereby the contracting of said first linear actuator effects a raising of said head member and whereby the extending of said first linear actuator effects a lowering of said head member;

(e) a second L-shaped crank having the longest portion thereof approximately the length of the side member of said knee portion, the longest portion thereof being rigidly secured at the free end thereof to said cross member intermediate the ends thereof, and the juncture of the longer portion and the shorter portion being pivotably secured to said support means with the free end thereof extending downwardly;

(f) a second linear actuator carried at one end by said support means adjacent said foot member and pivotably connected at the other end to the free end of the shortest portion of said second L-shaped crank whereby the contracting of said second linear actuator effects a raising of the junction of said thigh portion and said foot portion and whereby the extending of said second linear actuator effects a lowering of the junction of said thigh portion and said foot portion; and (g) a plurality of transverse slats carried at opposite ends by the side members of said head, fixed, thigh and foot portions.

3. The system of claim 2 wherein at least one of the spring rate, the spacing, and the thickness of said slats varies over the length of the bed system as a function of slat position in the bed system and a predetermined individual body weight distribution.

4. The bed system of claim 3 wherein said support means includes a rigid enclosure laterally enclosing said articulating frame when flat to enhnace the appearance of the bed system.

5. The bed system of claim 2 including a mattress of high resiliency foam grooved over the pivot lines of said articulating frame to permit the bending thereof.

6. The system of claim 5 wherein at least one of said grooves is sufficently wide to substantially eliminate buckling of said mattress when said mattress is folded in a direction narrowing said grooves.

7. The bed system of claim 2 wherein said support means includes a rigid enclosure laterally enclosing said articulating frame when flat to enhance the appearance of the bed system.

8. A slatted bed system comprising:

(a) support means;

(b) an articulating frame carried by said support means, said frame having a head movable portion, a fixed portion, a thigh movable portion and a foot portion, said fixed portion including a pair of side members supported by said support means, said head portion including two side members and a head end member rigidly secured thereto at one end, each of said side members being pivotably secured at the other end thereof to the adjacent end of one of the side members of said fixed portion, said thigh portion including two side members and a cross member rigidly secured thereto adjacent the end thereof nearest to said foot portion, said side members being secured at the other end thereof to the adjacent ends of the side members of said fixed portion, said foot portion including two side members and a foot end member rigidly secured thereto at one end, each of said side members being pivotably secured at the other end thereof to the end of one of the side members of said knee portion;

(c) first acuator means carried at one end by said support means adjacent said head member for raising and lowering said head member;

(d) second actuator means carried at one end by said support means adjacent said foot member for raising and lowering the junction of said thigh portion and said foot portion; and (e) a plurality of resilient supports;

(f) a plurality of transverse slats carried at opposite ends by the side members of said head, fixed, thigh and foot portions, each of said slats being concave downwardly and selectively positionable along the length of the bed parallel to said foot, cross and head member, at least one of the spring rate and the thickness of said slats varies over the length of the bed system as a function of slat position in the bed system and a predetermined individual body weight distribution; and (g) means for removably securing the ends of said slats to one of said side members through one of said resilient supports.

* * * * *